United States Patent [19]

Frost

[11] Patent Number: 5,031,584

[45] Date of Patent: Jul. 16, 1991

[54] VARIABLE LIFT VALVES

[75] Inventor: Derek Frost, Leigh-on-Sea, England

[73] Assignee: Ford Motor Company, Dearborn, Mich.

[21] Appl. No.: 548,897

[22] PCT Filed: Jan. 20, 1989

[86] PCT No.: PCT/GB89/00059

§ 371 Date: Sep. 17, 1990

§ 102(e) Date: Sep. 17, 1990

[87] PCT Pub. No.: WO89/06742

PCT Pub. Date: Jul. 27, 1989

[30] Foreign Application Priority Data

Jan. 22, 1988 [GB] United Kingdom ..... 8801425

[51] Int. Cl.[5] ..... F01L 1/34

[52] U.S. Cl. ..... 123/90.16; 123/90.39

[58] Field of Search ..... 123/90.15, 90.16, 90.49, 123/90.27, 90.39, 90.41

[56] References Cited

U.S. PATENT DOCUMENTS

| | | | |
|---|---|---|---|
| 4,397,270 | 8/1983 | Aoyama | 123/90.16 |
| 4,438,736 | 3/1984 | Hara et al. | 123/90.16 |
| 4,459,946 | 7/1984 | Burandt | 123/90.16 |
| 4,572,118 | 2/1986 | Baguéna | 123/90.16 |
| 4,699,094 | 10/1987 | Stegeman | 123/90.49 |
| 4,724,822 | 2/1988 | Bonvallet | 123/90.16 |
| 4,911,124 | 3/1990 | Bennett | 123/90.16 |

FOREIGN PATENT DOCUMENTS

| | | | |
|---|---|---|---|
| 0168211 | 9/1984 | Japan | 123/90.16 |
| 0168212 | 9/1984 | Japan | 123/90.16 |
| 0228717 | 11/1985 | Japan | 123/90.16 |

*Primary Examiner*—David A. Okonsky
*Assistant Examiner*—Weilun Lo
*Attorney, Agent, or Firm*—Jerome R. Drouillard; Clifford L. Sadler

[57] ABSTRACT

A mechanism is described for achieving variable lift of a valve of an internal combustion engine having an overhead camshaft disposed above the valves. The mechanism comprises two levers both pivoted about fixed fulcrums and a coupling member which is movable along overlapping arms of the two levers to vary the mechanical advantage and thereby vary the valve lift in dependence upon the position of the coupling member.

4 Claims, 2 Drawing Sheets

VARIABLE LIFT VALVES

The present invention relates to an arrangement for varying the degree of valve lift in an internal combustion engine and in particular to an arrangement which permits such variation without at the same time altering the phase of opening of the valve.

The volume of the intake charge of any cylinder varies with the operating conditions and if a fixed degree of valve lift is used under all operating conditions, as is the case in conventional engines, then the velocity of the charge through the skirt area and the resultant turbulence in the charge will vary over the engine operating range. It is clearly desirable, therefore, to be able to vary the valve lift so as to enable the air flow conditions to be optimised over the full operating range and in particular to permit higher air velocities under low speed part load conditions.

The prior art discloses arrangements which permit the geometry of the intake port to be varied with the same aim in mind but these are less effective in the control of the air velocities since it is at the skirt area that the velocity is of importance and the closer the control mechanism is to this region, the more effective it will prove.

Variable lift valves have been proposed (see for example GB No. 1201872, GB No. 1201558 and GB No. 682628) in which the position of a fulcrum of a rocker acting between a push rod and a valve can be varied to alter the mechanical advantage of the rocker and thereby alter the valve lift. Such arrangement have the disadvantage that they cannot be used in a overhead camshaft engine in which the camshaft is mounted in line with and above the valve stems.

According to the present invention, there is provided a mechanism for achieving variable lift of a valve of an internal combustion engine having a fixed profile overhead camshaft, characterised by a lever arrangement interposed between the camshaft and the valve, which lever arrangement includes a first fixed fulcrum lever acted upon by the camshaft, a second fixed fulcrum lever arranged to actuate the valve and a coupling member movable relative to the fulcrums of the two levers for transmitting the movement of the first lever to the second lever.

Each of the two levers may be constructed as a single arm lever but, depending upon the geometry of the cylinder head, one or both of the levers may alternatively be two armed levers. It is important in all cases that one arm of the first lever should overlie an arm of the second lever so that movement of one can be directly transmitted to the other.

The travel of the second lever will vary with the position of the coupling member and in some cases, depending upon the lift height and the separation of the levers, the lower lever may overlap the position of the upper lever in a horizontal plane. Collision between the levers can be avoided by offsetting one of the levers to one side in the horizontal plane but this step alone would cause a bending moment to be applied to the coupling between the levers. It is therefore preferred in this case for the first lever to be bifurcated and to straddle the second lever. This bifurcation of the first lever is also effective to prevent direct collision between the first lever and the valve spring retainer plate.

The coupling member between the levers may comprise a roller movable along the length of the overlapping lever arms. Such a roller may be supported on a sheet metal cage and movement of the roller can be effected by a rack and pinion mechanism in which the rack is constituted by or supported on the cage while the pinion can be formed on or driven by the shaft on which one of the levers is journalled.

As an alternative, the coupling member may consist of a roller carried by a further lever pivotably mounted on the outer end of an arm projecting from the shaft on which one of the levers is journalled. As the latter shaft is turned, the further levers for all the cylinders are moved in unison to vary the positions of their respective rollers relative to the first and second levers of the valves.

It is an important advantage of the invention that the point of contact of the second lever with the valve does not vary with the valve lift and consequently a conventional hydraulic tappet may be incorporated in the second levers so that free play between the cam and valve is taken up at all times. In this case, oil pressure to the hydraulic tappets may be transmitted along the support shaft and the second levers.

The invention will now be described further, by way of example, with reference to the accompanying drawings, in which.

Figure 1:
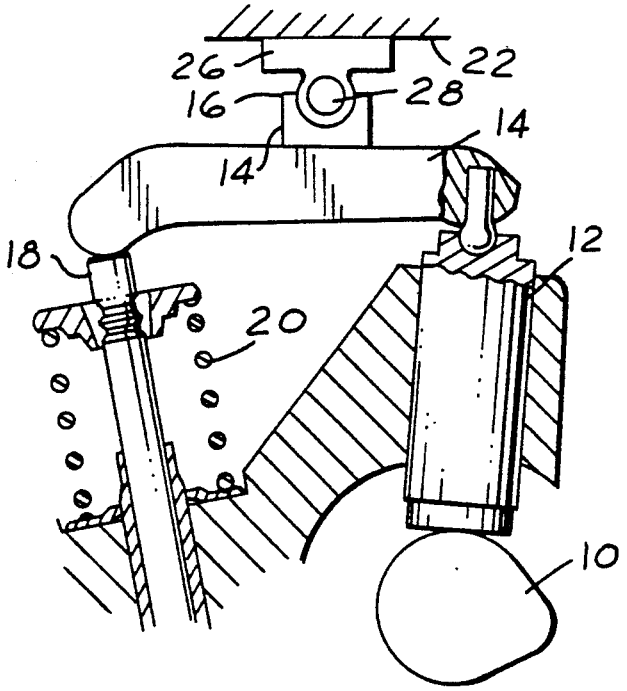
(PRIOR ART) FIG. 1
FIG. 1 is a schematic representation of a prior art arrangement for achieving variable valve lift.

In FIG. 1, there is shown a camshaft 10 acting on a valve 18 against the force of the valve spring 20 by way of a train comprising a cam follower 12 and a rocker lever 14 pivotable about a fulcrum 16.

Whereas the fulcrum of the rocker lever of conventional engine is usually fixed, in the arrangement shown in FIG. 1, the position of the fulcrum 16 is adjustable to vary the mechanical advantage of the lever and thereby adjust the maximum lift of the valve 18 even though the cam 10 has a fixed profile. To this end, the mechanism of the fulcrum 16 comprises two blocks 24 and 26 joined to one another by a pivot pin 28. The block 26 can slide along a track 22 while the block 24 can slide along the length of the rocker lever 14, which is also formed with a suitable track for guiding the block 24. Though movable in the plane of the drawing, because of the tracks, the fulcrum mechanism prevents movement of the rocker lever 14 out of the plane of the drawing.

While a mechanism as shown in FIG. 1 can vary valve lift in an engine in which the cam 10 is mounted to one side of the valves 18, it cannot be used in overhead camshaft engines in which the camshaft is arranged above the stems of the valves.

Figure 2:
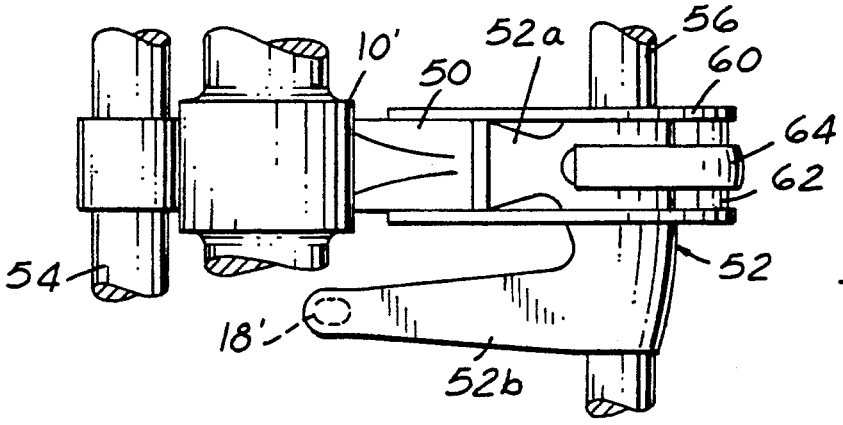
FIG. 2 is a plan view of an embodiment of the present invention.
Figure 3:
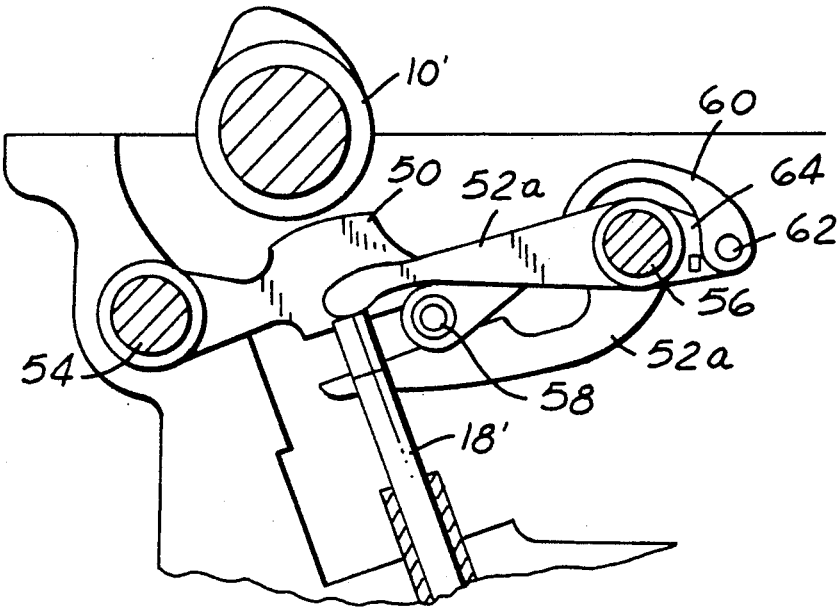
FIG. 3 shows a similar view to that of FIG. 1 of the embodiment of the invention shown in FIG. 2.

The embodiment of the present invention illustrated in FIGS. 2 and 3 overcomes this problem and comprises two interacting levers 50 and 52 interposed between the camshaft 10, and the valve 18'. The lever 50 is a fixed fulcrum lever pivotable about a shaft 54 and acted upon directly by the camshaft 10, The lever 52 has two arms **52*a* and 52*b* which move in unison about a shaft 56. The lever arm 52*a* is disposed below the lever 50 and is moved by the latter through a coupling member 58 which is shown as being a pin. The resulting movement of the lever arm 52*b* causes the valve 18'** to be opened against the action of the valve spring (not shown).

The mechanical advantage of the mechanism comprising the levers 50 and 52 depends upon the position of the coupling member 58. To permit this position to be adjusted, the coupling member 58 is mounted on a link arm 60 assembly formed of two plates straddling the coupling member 58 and pivotable about the axis of a pin 62 passing through an adjusting arm 64 projecting radially from the shaft 56 and mounted for rotation with the shaft 56.

If the shaft 56 is rotated, the adjusting arm 64 moves the position of the pin 62 which now moves the link arm 60 to reposition the coupling member 58 between the two levers 50 and 52*a*. The closer the coupling member 58 to the shaft 54, the less the lift of the valve 18, In any one position of the coupling member 58, the levers 50 and 52*a* will both rotate relative to the coupling member 58 during the opening of the valve and only line contact can be maintained. For this reason, the coupling member has been shown as a pin rather than a flat block. However, such line contact may cause severe wear and it is possible to substitute for the pin a two part block which incorporates a bearing surface, in a manner analogous to the block shown in FIG. 1.

The valve springs 20 are relatively stiff and one or other of the springs of an engine is compressed at any angle of the camshaft 10. Thus if movement of all the coupling members 58 is effected simultaneously, then the force required must exceed the resistant of the valve springs. However, there are times when each coupling member associated with one of cylinder can be moved with minimal effort, namely when the valve is fully closed. To take advantage of this, one may stagger the movement of the individual coupling members so that each member 58 fulcrum is moved when it presents a minimum resistance.

For example, the coupling member 58 may be moved by way of a spring biased lost motion mechanism arranged between the adjusting arm 64 and the shaft 56. The spring in the lost motion mechanism is sufficiently strong to move the coupling member 58 when the valve is closed but not otherwise. If the coupling members 58 of all the cylinders are to be adjusted, then the shaft 56 is rotated to compress the springs of all the lost motion mechanisms. However, the individual link arms 60 will not move and displace their coupling members 58 until such time as the associated valve is closed and the coupling member 58 is not compressed between the two levers 50 and 52.

If it is desired to incorporate a hydraulic tappet then this may be placed between the tip of the valve 18, and the lever arm 52*b*. Oil for the hydraulic tappet can be supplied along the pivot shaft 56 and the lever arms 52*b*.

Figure 4:
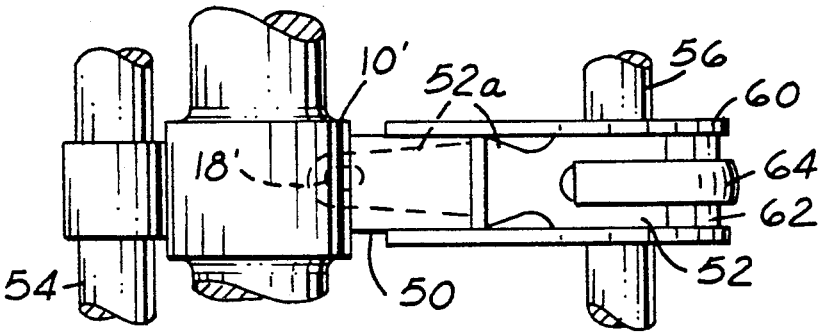
FIG. 4 shows a second embodiment according to the present invention.

In the embodiment of FIG. 4, lever 52 has a single arm, 52*a*, which acts directly upon the tip of the valve 18'.

The preferred embodiment of the invention can thus be seen to permit valve lift to be varied in an engine with an overhead camshaft arranged above the valves and to offer the additional advantage of enabling adjustment by a particularly simple and effective control system. The effort required for movement of the control system can be minimal this being important in order to avoid power losses.

I claim:

1. A mechanism for achieving variable lift of a valve of an internal combustion engine having a fixed profile overhead camshaft, characterised by a lever arrangement interposed between the camshaft and the valve, which lever arrangement includes a first pivotably fixed fulcrum lever (50) acted upon by the camshaft (10'), a second pivotably fixed fulcrum lever (52) arranged to actuate the valve (18'), and a coupling member (58) movable relative to respective fulcrums of the two levers (50,52) for transmitting the movement of the first lever (50) to the second lever (52), wherein the coupling member comprises a pin (58) carried by a further lever (60) pivotably mounted on an outer end of an arm (64) projecting from a shaft (56) on which one of the first and second levers (50,52) is journalled.

2. A mechanism as claimed in claim 1, wherein each of the two levers (50,52) is constructed as a single arm lever.

3. A mechanism as claimed in claim 1, wherein at least one of the levers (50,52) is a two armed lever.

4. A mechanism as claimed in claim 1, wherein the coupling member (58) is positioned between overlapping portion of the levers (50,52) and comprises a pin movable (58) along the length of the overlapping lever arms (50,52*a*).

* * * * *